US009489876B2

(12) United States Patent
Liu et al.

(10) Patent No.: US 9,489,876 B2
(45) Date of Patent: Nov. 8, 2016

(54) METHOD OF INSPECTING PIXEL ARRAY SUBSTRATE AND APPARATUS FOR INSPECTING PIXEL ARRAY SUBSTRATE

(71) Applicant: E Ink Holdings Inc., Hsinchu (TW)

(72) Inventors: Chuan-Feng Liu, Hsinchu (TW); Jen-Shiun Huang, Hsinchu (TW); Pei-Lin Huang, Hsinchu (TW); Shi-Lin Li, Hsinchu (TW); Chen-Fa Tsai, Hsinchu (TW); Yung-Sheng Chang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 40 days.

(21) Appl. No.: 14/178,283

(22) Filed: Feb. 12, 2014

(65) Prior Publication Data

US 2014/0320137 A1 Oct. 30, 2014

(30) Foreign Application Priority Data

Apr. 29, 2013 (TW) ..... 102115288 A

(51) Int. Cl.

| | |
|---|---|
| ***G09G 3/00*** | (2006.01) |
| *G09G 3/20* | (2006.01) |
| *G09G 3/34* | (2006.01) |

(52) U.S. Cl.

CPC ..... *G09G 3/006* (2013.01); *G09G 3/20* (2013.01); *G09G 3/344* (2013.01); *G09G 2300/0847* (2013.01); *G09G 2360/145* (2013.01)

(58) Field of Classification Search

CPC ..... G09G 3/006; G01R 31/2635

See application file for complete search history.

(56) References Cited

U.S. PATENT DOCUMENTS

| | | | | |
|---|---|---|---|---|
| 7,859,274 | B2 | 12/2010 | Kim et al. | |
| 2009/0079345 | A1* | 3/2009 | Inuiya | 313/523 |
| 2009/0224777 | A1* | 9/2009 | Kim et al. | 324/750 |
| 2010/0277740 | A1* | 11/2010 | Hulteen et al. | 356/445 |
| 2013/0082264 | A1* | 4/2013 | Couture et al. | 257/59 |

FOREIGN PATENT DOCUMENTS

| | | |
|---|---|---|
| CN | 1616977 | 5/2005 |
| CN | 101384948 | 3/2009 |
| TW | 305975 | 5/1997 |
| TW | 200841028 | 10/2008 |
| TW | 201022772 | 6/2010 |
| TW | 201102637 | 1/2011 |

(Continued)

OTHER PUBLICATIONS

"Office Action of Taiwan Counterpart Application", issued on Sep. 11, 2014, p. 1-p. 6, in which the listed references were cited.

(Continued)

*Primary Examiner* — Tung X Nguyen
*Assistant Examiner* — Feba Pothen
(74) *Attorney, Agent, or Firm* — Jianq Chyun IP Office

(57) ABSTRACT

An inspection method including following steps is provided. A pixel array substrate including a plurality of pixel units is in contact with a photoelectric inspection device. A plurality of electrical signals is inputted to the pixel units of the pixel array substrate and the photoelectric inspection device. Based on an optical property of the photoelectric inspection device, the pixel units of the pixel array substrate are being examined on whether they are normal or not. Moreover, an inspection apparatus realizing the inspection method is also provided.

19 Claims, 3 Drawing Sheets

(56) References Cited

FOREIGN PATENT DOCUMENTS

| | | |
|---|---|---|
| TW | 201224488 | 6/2012 |
| TW | M444519 | 1/2013 |

OTHER PUBLICATIONS

"Office Action of China Counterpart Application", issued on May 16, 2016, p. 1-p. 14, in which the listed references were cited.

* cited by examiner

METHOD OF INSPECTING PIXEL ARRAY SUBSTRATE AND APPARATUS FOR INSPECTING PIXEL ARRAY SUBSTRATE

CROSS-REFERENCE TO RELATED APPLICATION

This application claims the priority benefit of Taiwan application serial no. 102115288, filed on Apr. 29, 2013. The entirety of the above-mentioned patent application is hereby incorporated by reference herein and made a part of this specification.

BACKGROUND

1. Field of the Application

The invention relates to an inspection method and an inspection apparatus, and more particularly, to an inspection method for inspecting a pixel array substrate and an inspection apparatus using the same.

2. Description of Related Art

A display includes a pixel array substrate and an opposite substrate. In a manufacturing process of the display, the pixel array substrate and the opposite substrate are respectively manufactured. Then, the pixel array substrate and the opposite substrate are assembled in a group to complete the display. In general, the pixel array substrate is inspected before the pixel array substrate and the opposite substrate are assembled in a group.

In the conventional techniques, a fixture has to be changed when inspecting of the pixel array substrate, and a probe on the fixture is not easily aligned with the pixel array substrate, or a gap between a modulator used for inspecting the pixel array substrate and the pixel array substrate is difficult to be controlled, and the pixel array substrate is easily be scratched. In other words, the conventional inspection method is complicated, and the conventional inspection apparatus has a complex structure and is expensive.

SUMMARY OF THE APPLICATION

The invention provides an inspection method capable of easily inspecting a pixel array substrate.

The invention provides an inspection apparatus capable of inspecting a pixel array substrate and has a low price.

An inspection method of the invention includes the following steps. A photoelectric inspection device is in contact with a pixel array substrate including a plurality of pixel units. A plurality of electrical signals is inputted to the pixel units of the pixel array substrate and the photoelectric inspection device. Based on an optical property of the photoelectric inspection device, the pixel units of the pixel array substrate are being determined on whether they are normal or not.

An inspection apparatus of the invention is configured to inspect a pixel array substrate including a plurality of pixel units. The inspection apparatus includes a photoelectric inspection device configured to be in contact with the pixel array substrate, a signal source configured to output a plurality of electrical signals to the pixel units of the pixel array substrate and the photoelectric inspection device, and an analysis unit configured to determine whether the pixel units of the pixel array substrate are normal or not based on an optical property of the photoelectric inspection device.

In an embodiment of the invention, each of the pixel units includes at least one active element and a pixel electrode electrically connected with the active element. The step of enabling the photoelectric inspection device to be in contact with the pixel array substrate includes: disposing the photoelectric inspection device on the pixel array substrate, so that the photoelectric inspection device is in contact with the pixel electrodes of the pixel units.

In an embodiment of the invention, the photoelectric inspection device includes a base and a display medium layer located on the base. The step of enabling the photoelectric inspection device to be in contact with the pixel array substrate is: to dispose the photoelectric inspection device on the pixel array substrate, so that the display medium layer of the photoelectric inspection device is in contact with the pixel array substrate.

In an embodiment of the invention, the photoelectric inspection device includes a base, an anisotropic conductive film located on the base and a display medium layer located between the anisotropic conductive film and the base. The step of enabling the photoelectric inspection device to be in contact with the pixel array substrate is: to dispose the photoelectric inspection device on the pixel array substrate, so that the anisotropic conductive film of the photoelectric inspection device is in contact with the pixel array substrate.

In an embodiment of the invention, after the inspection method enables the photoelectric inspection device to be in contact with the pixel array substrate, if further includes applying a pressure to fix the pixel array substrate and the photoelectric inspection device.

In an embodiment of the invention, the photoelectric inspection device includes a base and a display medium layer located on the base. The display medium layer includes an electronic ink layer or an organic light emitting diode layer.

In an embodiment of the invention, the photoelectric inspection device includes a base, a display medium layer disposed on the base and a common electrode layer disposed between the base and the display medium layer. The step of inputting the electrical signals to the pixel units of the pixel array substrate and the photoelectric inspection device is: to input the electrical signals to the pixel units of the pixel array substrate and the common electrode layer of the photoelectric inspection device.

In an embodiment of the invention, the pixel array substrate further includes a common electrode terminal. The step of inputting the electrical signals to the pixel units of the pixel array substrate and the photoelectric inspection device is: to input the electrical signals to the pixel units of the pixel array substrate and the common electrode terminal, wherein one of the electrical signals is transmitted to the common electrode layer of the photoelectric inspection device through the common electrode terminal.

In an embodiment of the invention, the photoelectric inspection device is divided into a plurality of inspection blocks, and the pixel array substrate is divided into a plurality of to-be inspected blocks respectively including a plurality of pixel units. The step of enabling the photoelectric inspection device to be in contact with the pixel array substrate is: to enable the inspection blocks of the photoelectric inspection device to be respectively in contact with the to-be inspected blocks of the pixel array substrate. The step of determining whether the pixel units of the pixel array substrate are normal or not based on the optical property of the photoelectric inspection device is: to compare differences between an optical property of the inspection blocks and an expected optical property of the inspection blocks of the photoelectric inspection device when the electrical signals are inputted to the pixel units and the photoelectric inspection device, if the optical property of one of the inspection blocks of the photoelectric inspection device is different from the expected optical property of one of the inspection blocks, then the pixel unit of the to-be inspected block in contact with this inspection block is determined to be abnormal.

In an embodiment of the invention, each of the pixel units includes an active element having a source, a gate and a drain, a pixel electrode electrically connected with the drain of the active element, a data line electrically connected with the source of the active element, and a scan line connected with the gate of the active element.

In an embodiment of the invention, the inspection apparatus further includes a photodetector. The photodetector is configured to detect the optical property of the photoelectric inspection device, and the optical property of the photoelectric inspection device detected by the photodetector is send to the analysis unit.

In an embodiment of the invention, the photoelectric inspection device is configured to be in contact with the pixel electrodes of the pixel units.

In an embodiment of the invention, the photoelectric inspection device includes a base, a display medium layer located on the base and a common electrode layer located between the base and the display medium layer.

In an embodiment of the invention, the display medium layer of the photoelectric inspection device is configured to be in contact with the pixel array substrate, and the common electrode layer is configured to receive one of the electrical signals.

In an embodiment of the invention, the photoelectric inspection device further includes an anisotropic conductive film. The display medium layer is located between the anisotropic conductive film and the common electrode layer. The anisotropic conductive film is configured to be in contact with the pixel array substrate, and the common electrode layer is configured to receive one of the electrical signals.

In an embodiment of the invention, the anisotropic conductive film has electroconductivity in direction perpendicular to the base, and has no electroconductivity at another direction parallel to the base.

In an embodiment of the invention, the photoelectric inspection device further includes a conductive structure extending outward from the base and common electrically connected with the electrode layer. The conductive structure is configured to be in contact with the common electrode terminal of the pixel array substrate.

In an embodiment of the invention, the electrical signals outputted by the signal source are configured to be inputted to the pixel units of the pixel array substrate and the common electrode terminal. One of the electrical signals is transmitted to the common electrode layer of the photoelectric inspection device through the common electrode terminal.

In an embodiment of the invention, the analysis unit is configured to compare differences between an optical property of the inspection blocks and an expected optical property of the inspection blocks of the photoelectric inspection device when the electrical signals is inputted to the pixel units and the photoelectric inspection device, if the optical property of one of the inspection blocks of the photoelectric inspection device is different from the expected optical property of one of the inspection blocks, then the pixel unit of the to-be inspected block in contact with this inspection block is determined to be abnormal.

According to the foregoing, the inspection method and the inspection apparatus in the embodiments of the invention enable the photoelectric inspection device to be in contact with the to-be inspected pixel array substrate and inputs the electrical signals to the pixel array substrate and the photoelectric inspection device, and then determines whether the pixel units of the pixel array substrate are normal or not based on the optical property of the photoelectric inspection device. The inspection apparatus in the embodiments of the invention has a simple structure, low manufacturing cost, and may easily determine defects of the pixel array substrate. The defects of the pixel array substrate may be easily determined by using the inspection method and the inspection apparatus described in the embodiments of the invention, and subsequent processing materials and time may be avoided from being wasted, thereby achieving a purpose of reducing the costs.

In order to make the abovementioned and other features and advantages of the present application more comprehensible, several embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
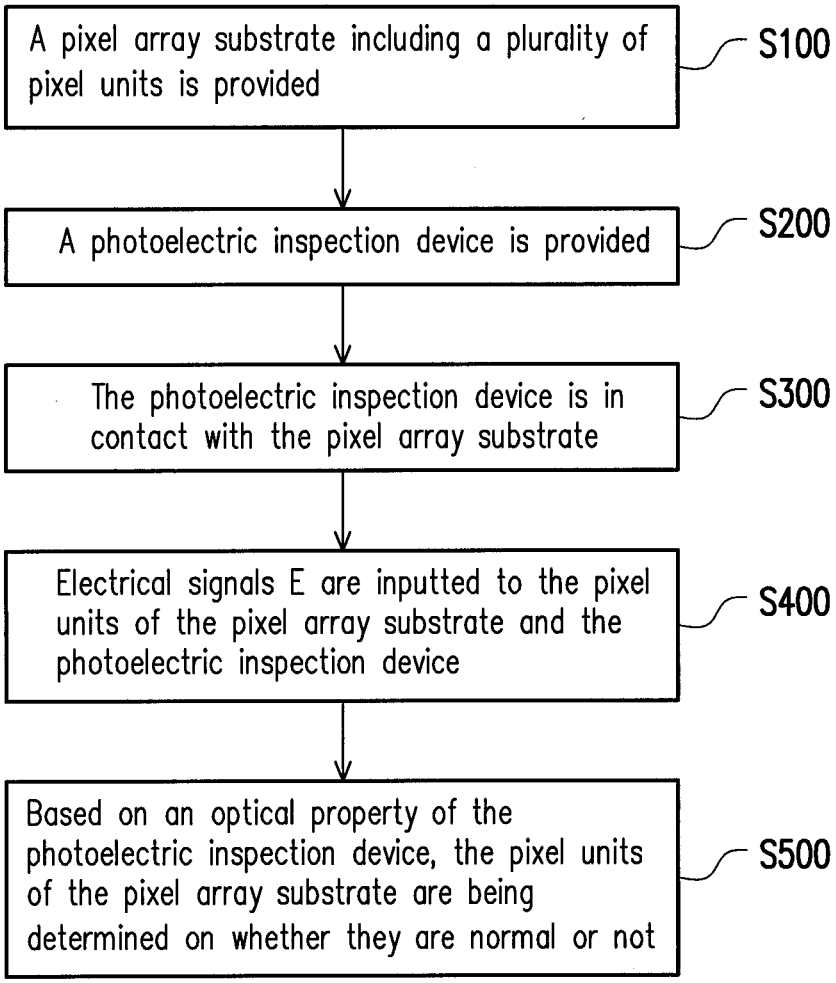
FIG. 1 is a schematic flow diagram illustrating an inspection method according to an embodiment of the invention.
Figure 2:
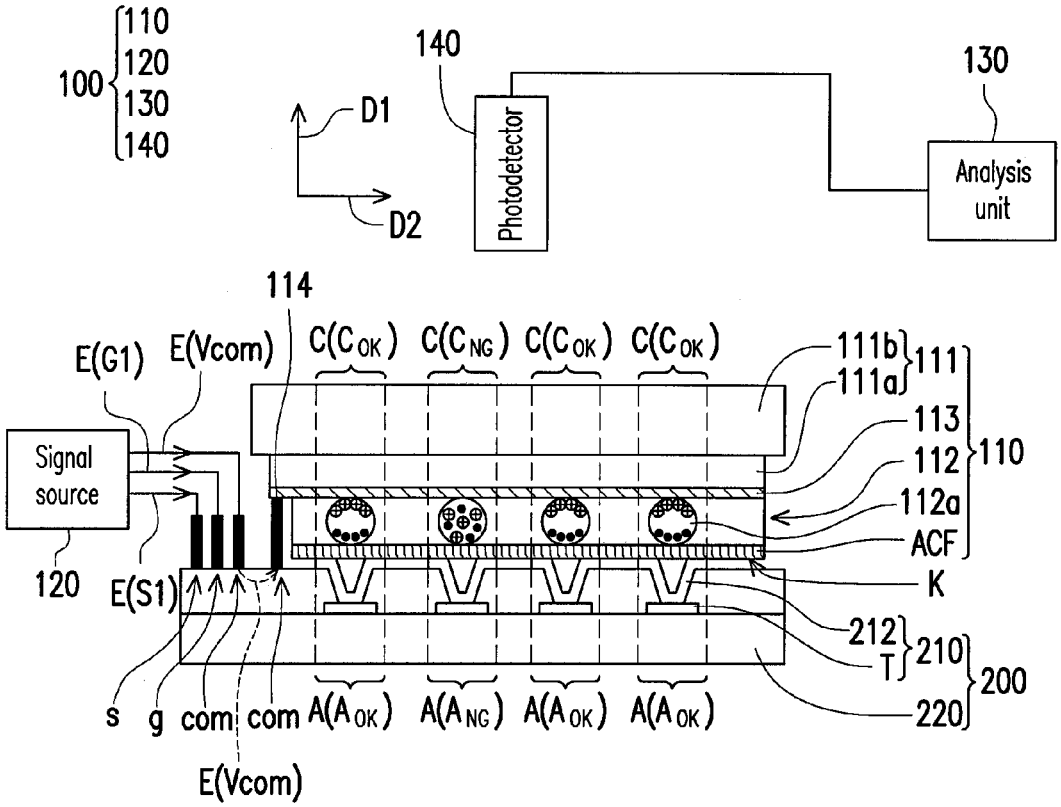
FIG. 2 is a schematic diagram illustrating an inspection apparatus according to an embodiment of the invention.

FIG. 1 is a schematic flow diagram illustrating an inspection method according to an embodiment of the invention. FIG. 2 is a schematic diagram illustrating an inspection apparatus according to an embodiment of the invention. In particular, the inspection apparatus 100 of FIG. 2 can specifically implement the inspection method of FIG. 1. The inspection method and the inspection apparatus 100 are to be explained in detail, along with FIG. 1 and FIG. 2, in the following.

Figure 3:
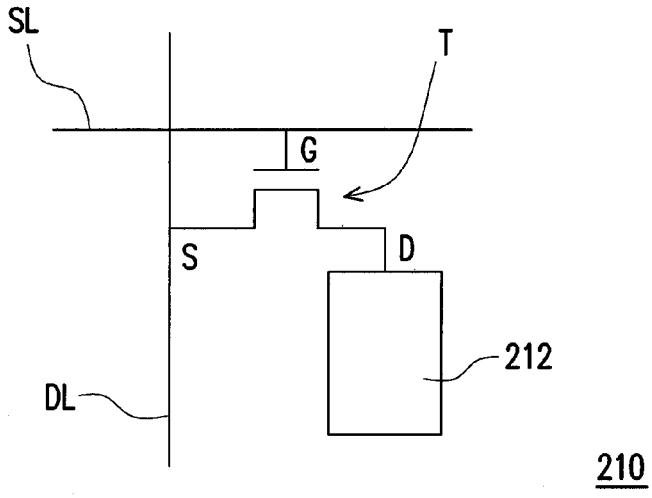
FIG. 3 is a circuit diagram illustrating a pixel unit of FIG. 2.

Referring to FIG. 1 and FIG. 2, the inspection method and the inspection apparatus 100 of the present embodiment are configured to inspect a pixel array substrate 200 including a plurality of pixel units 210. Firstly, the pixel array substrate 200 including the pixel units 210 is provided (step S100). As shown in FIG. 2, in the present embodiment, the pixel array substrate 200 further includes a substrate 220, and the pixel units 210 are disposed on the substrate 220. Each of the pixel units 210 includes at least one active element T and a pixel electrode 212 electrically connected with the active element T. FIG. 3 is a circuit diagram illustrating a pixel unit of FIG. 2. Referring to FIG. 3, the active element T (such as a thin film transistor) has a source S, a gate G and a drain D. The pixel electrode 212 is electrically connected with the drain D of the active element T. Each of the pixel units 210 further includes a data line DL electrically connected with the source S of the active element T and a scan line SL electrically connected with the gate G of the active element T.

Referring to FIG. 1 and FIG. 2 again, next, a photoelectric inspection device 110 is provided (step S200). As shown in FIG. 2, in the present embodiment, the photoelectric inspection device 110 includes a base 111, a display medium layer 112 located on the base 111 and a common electrode layer 113 located between the base 111 and the display medium layer 112. The base 111 includes a flexible light transmissive substrate 111*a* and a rigid light transmissive substrate 111*b*. In the present embodiment, the display medium layer 112, for example, is an electronic ink layer. The electronic ink layer includes a plurality of microcapsules 112*a*. Each of the microcapsules 112*a* includes positively charged white particles and negatively charged black particles therein. However, the invention is not limited thereto. In other embodiments, the display medium layer 112 may also be other types of proper display medium layer, such as an organic light-emitting diode (OLED) layer.

Then, the photoelectric inspection device 110 is in contact with the pixel array substrate 200 (step S300). Specifically, the inspection apparatus 100 of the present embodiment includes the photoelectric inspection device 110. The inspection apparatus 100 may dispose the photoelectric inspection device 110 on the pixel array substrate 200, so that the photoelectric inspection device 110 is in contact with the pixel array substrate 200. In the present embodiment, the photoelectric inspection device 110 may be in contact with the pixel electrode 212 or each of the pixel units 210. However, the invention is not limited thereto, and in other embodiments, the to-be inspected pixel array substrate 200 may include a passivation layer covering the pixel units 210. The photoelectric inspection device 110 may also be in contact with the passivation layer. An electrical field caused by an electrical signal E inputted into the pixel electrode 212 and the photoelectric inspection device 110 may still pass through the passivation layer, so that a portion of the display medium layer 112 corresponded to the pixel electrode 212 generates an action, and thus the photoelectric inspection device 110 may still exert a function of inspecting the pixel array substrate 200.

Figure 4:
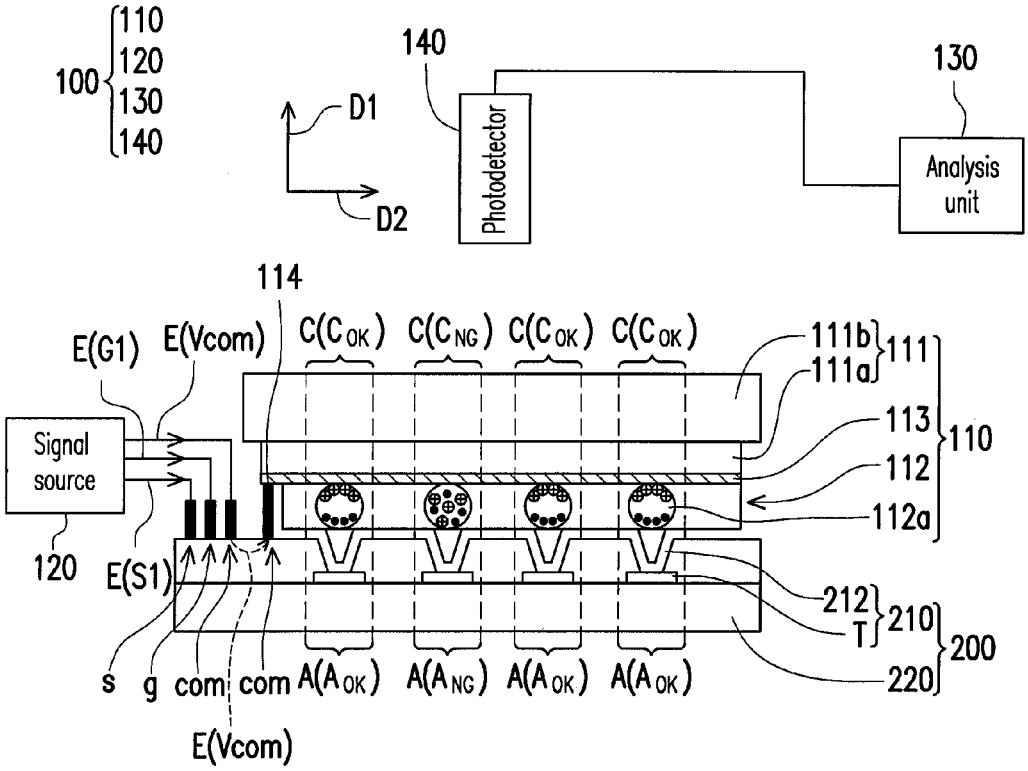
FIG. 4 is a schematic diagram illustrating an inspection apparatus according to another embodiment of the invention.

In the present embodiment, the photoelectric inspection device 110 may further include an anisotropic conductive film ACF, wherein the display medium layer 112 is located between the anisotropic conductive film ACF and the common electrode layer 113. The step of enabling the photoelectric inspection device 110 to be in contact with the pixel array substrate 200 may enable the anisotropic conductive film ACF of the photoelectric inspection device 110 to be in contact with the pixel array substrate 200. The anisotropic conductive film ACF has electroconductivity in a direction D1 perpendicular to the base 110, and has no electroconductivity in a direction D2 parallel to the base 110. The electroconductivity of the pixel array substrate 200 and the display medium layer 112 in the direction D1 may be increased via the anisotropic conductive film ACF. In addition, a surface K of the anisotropic conductive film ACF facing towards the pixel array substrate 200 may has no adhesion, and thus the photoelectric inspection device 110, after finishing the inspection of one pixel array substrate 200, may move away from this pixel array substrate 200 and be in contact with the subsequent to-be inspected pixel array substrate 200. In other words, the photoelectric inspection device 110 is a movable type, and may repeatedly be in contact with the to-be inspected pixel array substrate 200. However, the invention is not limited to the above, and FIG. 4 is a schematic diagram illustrating an inspection apparatus according to another embodiment of the invention. Referring to FIG. 4, in this embodiment, the photoelectric inspection device 110 is able to not include the anisotropic conductive film ACF, and the pixel array substrate 200 may be in direct contact with the display medium layer 112 of the photoelectric inspection device 110.

In the present embodiment, after the photoelectric inspection device 110 is being in contact with the pixel array substrate 200, a pressure is applied to fix the pixel array substrate 200 and the photoelectric inspection device 110, so that the pixel array substrate 200 is in a favorable contact with the photoelectric inspection device 110, such that the electroconductivity between the pixel array substrate 200 and the display medium layer 112 is more favorable.

Next, the electrical signals E are inputted to the pixel units 210 of the pixel array substrate 200 and the photoelectric inspection device 110 (step S400). Specifically, the inspection apparatus 100 includes a signal source 120. The signal source 120 may output the electrical signals E to the pixel units 210 of the pixel array substrate 200 and the photoelectric inspection device 110. Furthermore, the electrical signals E may be inputted to the pixel units 210 of the pixel array substrate 200 and the common electrode layer 113 of the photoelectric inspection device 110. In detail, the pixel array substrate 200 further includes a common electrode terminal corn. The common electrode terminal com may be electrically connected with a plurality of common electrode lines of the pixel array substrate 200. A common electrode signal Vcom of one of the electrical signals E may be transmitted to the common electrode layer 113 of the photoelectric inspection device 110 through the common electrode terminal com.

In the present embodiment, the photoelectric inspection device 110 further includes a conductive structure 114 extending outward from the base 111 and electrically connected with the common electrode layer 113. The conductive structure 114 is configured to be in contact with the common electrode terminal com of the pixel array substrate 200. The common electrode signal Vcom inputted to the common electrode terminal corn may be transmitted to the common electrode layer 113 of the photoelectric inspection device 110 through the conductive structure 114. The pixel array substrate 200 may further include a common source terminal s, and the common source terminal s is electrically connected to the data lines DL of the pixel units 210. One electrical signal E (e.g., a data signal S1) outputted by the signal source 120 may be inputted to the common source terminal s. The pixel array substrate 200 further includes a common gate terminal g, and the common gate terminal g is electrically connected to the scan lines SL of the pixel units 210. One electrical signal E (e.g., a gate turn on signal G1) outputted by the signal source 120 may be inputted to the common gate terminal g.

Next, based on an optical property of the photoelectric inspection device 110, the pixel units 210 of the pixel array substrate 200 are being determined on whether they are normal or not (step S500). In detail, if the pixel units 210 are normal, then the electrical signals E inputted to the pixel units 210 and the photoelectric inspection device 110 may drive a portion of the display medium layer 112 above the pixel units 210, so that the optical property of a portion of the photoelectric inspection device 110 overlapping the pixel units 210 occurs a change. If the pixel units 210 are abnormal, then the electrical signals E inputted to the pixel units 210 and the photoelectric inspection device 110 are unable to drive the portion of the display medium layer 112 above the pixel units 210, normally, and the optical property of the portion of the photoelectric inspection device 110 overlapping the pixel units 210 appears to be abnormal. As such, defects of the pixel array substrate 200 may be inferred.

More specifically, in the present embodiment, the photoelectric inspection device 110 may be divided into a plurality of inspection blocks C. The pixel array substrate 200 may be divided into a plurality of to-be inspected blocks A of the pixel units 210. When the photoelectric inspection device 110 is in contact with the pixel array substrate 200, the inspection blocks C of the photoelectric inspection device 110 are respectively in contact with the to-be inspected blocks A of the pixel array substrate 200.

The step of determining whether the pixel units 210 of the pixel array substrate 200 are normal or not based on the optical property of the photoelectric inspection device 110 may be to compare differences between an optical property of the inspection blocks C and an expected optical property of the inspection blocks C when the electrical signals E are inputted to the pixel units 210 of the pixel array substrate 200 and the photoelectric inspection device 110, if the optical property of the inspection blocks $C_{NG}$ is different from the expected optical property of the inspection blocks $C_{NG}$, then the pixel unit 210 of the to-be inspected block $A_{NG}$ in contact with the inspection blocks $C_{NG}$ is determined to be abnormal. If the optical property of the inspection blocks $C_{ok}$ is the same as the expected optical property of the inspection blocks $C_{ok}$, then the pixel unit 210 of the to-be inspected blocks $A_{ok}$ in contact with the inspection blocks $C_{ok}$ is determined to be normal.

For example, in the present embodiment, if the pixel unit 210 is normal, then when the electrical signal E is inputted to the pixel unit 210 and the photoelectric inspection device 110, the electrical field between the pixel electrode 212 and the common electrode layer 113 causes the charged white particles in a microcapsule 112*a* to move, so that the inspection block Cok in contact with the to-be inspected block Aok including the pixel electrode 212 appears to have the expected optical property, and with this, the to-be inspected blocks Aok may accordingly be determined as normal. If the pixel unit 210 is abnormal, then when the electrical signal E is inputted into the pixel unit 210 and the photoelectric inspection device 110, the pixel electrode 212 and the common electrode layer 113 are unable to form a normal potential therebetween, so that a distribution of charged particles in the microcapsule 112*a* is abnormal. Now, the optical property (e.g., gray) of the inspection block CNG in contact with the to-be inspected block ANG including the pixel electrode 212 appears to be different from the expected optical property (e.g., white), such that the to-be inspected blocks ANG may accordingly be determined as abnormal.

Specifically, the inspection apparatus 100 includes an analysis unit 130, and the analysis unit 130 may execute an action of determining whether the pixel units 210 are normal or not based on the optical property of the photoelectric inspection device 110. The analysis unit 130 may be an inspector. However, the invention is not limited thereto, in order to realize an automation of the production process and to improve an accuracy of detection, in the present embodiment; functions of the inspector may be replaced with the machine. For example, the analysis unit 130 may be an electronic processor (e.g., a personal computer), and the inspection apparatus 100 further includes a photodetector 140, such as an image sensor. The electronic processor and the photodetector 140 may replace the functions of the inspector.

In detail, the photodetector 140 may detect the optical property of the photoelectric inspection device 110, and more particularly, detect the optical property of the photoelectric inspection device 110 when the electrical signals E are inputted to the pixel units 210 of the pixel array substrate 200 and the photoelectric inspection device 110. The optical property of the photoelectric inspection device 110 detected by the photodetector 140 is to be transmitted to the analysis unit 130. The analysis unit 130 may obtain the expected optical property of the photoelectric inspection device 110, and compare the expected optical property of the photoelectric inspection device 110 with the optical property of the photoelectric inspection device 110 detected by the photodetector 140 when the electrical signals E are inputted to the pixel units 210 of the pixel array substrate 200 and the photoelectric inspection device 110, so as to determine whether the pixel units 210 of the pixel array substrate 110 的 pixel units 210 are normal or not.

In summary, the inspection method and the inspection apparatus of the invention enable the photoelectric inspection device to be in contact with the to-be inspected pixel array substrate and input the electrical signals to the pixel array substrate and the photoelectric inspection device, and then determine whether the pixel units of the pixel array substrate are normal or not based on the optical property of the photoelectric inspection device. The inspection apparatus in the embodiments of the invention has the simple structure, low manufacturing costs, and may easily determine the defects of the pixel array substrate. The defects of the pixel array substrate may be easily determined by using the inspection method and the inspection apparatus described in the embodiments of the invention, and the subsequent processing materials and time may be avoided from being wasted, thereby achieving a purpose of reducing the costs.

What is claimed is:

1. An inspection method comprising:

providing a pixel array substrate, the pixel array substrate comprising a plurality of pixel units;

providing a photoelectric inspection device;

detachably contacting the photoelectric inspection device with the pixel array substrate, wherein the photoelectric inspection device comprises a base and a display medium layer located on the base;

inputting a plurality of electrical signals to the pixel units of the pixel array substrate and the photoelectric inspection device, wherein the display medium layer of the photoelectric inspection device contacting the pixel array substrate is driven by an electric field provided by the pixel array substrate to produce an optical property; and detecting the optical property of the photoelectric inspection device by a photo detector and determining whether the pixel units of the pixel array substrate are normal or not based on the detected optical property of the photodetector.

2. The inspection method as recited in claim 1, wherein each of the pixel units comprises at least one active element and a pixel electrode electrically connected with the at least one active element, and the step of detachably contacting the photoelectric inspection device to be in contact with the pixel array substrate comprises:

disposing the photoelectric inspection device on the pixel array substrate, so that the photoelectric inspection device is in contact with the pixel electrodes of the pixel units.

3. The inspection method as recited in claim 1, wherein the photoelectric inspection device further comprises a conductive structure, a thickness of the conductive structure is greater than a thickness of the display medium layer, and the step of detachably contacting the photoelectric inspection device with the pixel array substrate is:

disposing the photoelectric inspection device on the pixel array substrate, so that the display medium layer of the photoelectric inspection device is in contact with the pixel array substrate.

4. The inspection method as recited in claim 1, wherein the photoelectric inspection device further comprises an anisotropic conductive film located on the base and the display medium layer is located between the anisotropic conductive film and the base, so that the step of detachably contacting the photoelectric inspection device with the pixel array substrate is:

disposing the photoelectric inspection device on the pixel array substrate, so that the anisotropic conductive film of the photoelectric inspection device is in contact with the pixel array substrate.

5. The inspection method as recited in claim 1, after detachably contacting the photoelectric inspection device with the pixel array substrate, further comprising:

applying a pressure to fix the pixel array substrate and the photoelectric inspection device.

6. The inspection method as recited in claim 1, wherein the display medium layer comprises an electronic ink layer or an organic light emitting diode layer.

7. The inspection method as recited in claim 1, wherein the photoelectric inspection device further comprises a common electrode layer disposed between the base and the display medium layer, and the step of inputting the electrical signals to the pixel units of the pixel array substrate and the photoelectric inspection device is:

inputting the electrical signals to the pixel units of the pixel array substrate and the common electrode layer of the photoelectric inspection device.

8. The inspection method as recited in claim 7, wherein the pixel array substrate further comprises a common electrode terminal, and the step of inputting the electrical signals to the pixel units of the pixel array substrate and the photoelectric inspection device is:

inputting the electrical signals to the pixel units of the pixel array substrate and the common electrode terminal, wherein one of the electrical signals is transmitted to the common electrode layer of the photoelectric inspection device through the common electrode terminal.

9. The inspection method as recited in claim 1, wherein the photoelectric inspection device is divided into a plurality of inspection blocks, the pixel array substrate is divided into a plurality of to-be inspected blocks respectively comprising the pixel units, and the step of detachably contacting the photoelectric inspection device with the pixel array substrate is to detachably contacting the inspection blocks of the photoelectric inspection device with the to-be inspected blocks of the pixel array substrate, and the step of determining whether the pixel units of the pixel array substrate are normal or not based on the optical property of the photoelectric inspection device is:

comparing differences between an optical property of the inspection blocks and an expected optical property of the inspection blocks of the photoelectric inspection device when the electrical signals are inputted to the pixel units of the pixel array substrate and the photoelectric inspection device, if the optical property of one of the inspection blocks of the photoelectric inspection device is different from the expected optical property of one of the inspection blocks, then the pixel unit of the to-be inspected block in contact with the one of the inspection blocks is determined to be abnormal.

10. An inspection apparatus configured to inspect a pixel array substrate comprising a plurality of pixel units, the inspection apparatus comprising:

a photoelectric inspection device configured to be detachably in contact with the pixel array substrate, wherein the photoelectric inspection device comprises a base and a display medium layer located on the base, and the display medium layer is configured for producing an optical property under an electric field provided by the pixel array substrate;

a signal source configured to output a plurality of electrical signals to the pixel units of the pixel array substrate and the photoelectric inspection device;

an analysis unit configured to determine whether the pixel units of the pixel array substrate are normal or not based on the optical property of the photoelectric inspection device; and a photodetector configured to detect the optical property of the photoelectric inspection device, and the optical property of the photoelectric inspection device detected by the photodetector being sent to the analysis unit.

11. The inspection apparatus as recited in claim 10, being configured to inspect the pixel array substrate comprising the pixel units, and each of the pixel units comprising at least one active element and a pixel electrode electrically connected with the at least one active element, wherein the photoelectric inspection device is configured to be in contact with the pixel electrodes of the pixel units.

12. The inspection apparatus as recited in claim 10, wherein the photoelectric inspection device further comprises a conductive structure and a common electrode layer located between the base and the display medium layer, and a thickness of the conductive structure is greater than a thickness of the display medium layer.

13. The inspection apparatus as recited in claim 12, wherein the display medium layer of the photoelectric inspection device is configured to be in contact with the pixel array substrate, and the common electrode layer is configured to received one of the electrical signals.

14. The inspection apparatus as recited in claim 12, wherein the photoelectric inspection device further comprises an anisotropic conductive film, the display medium layer is located between the anisotropic conductive film and the common electrode layer, the anisotropic conductive film is configured to be in contact with the pixel array substrate, and the common electrode layer is configured to receive one of the electrical signals.

15. The inspection apparatus as recited in claim 14, wherein the anisotropic conductive film has electroconductivity in a direction perpendicular to the base, and has no electroconductivity in another direction parallel to the base.

16. The inspection apparatus as recited in claim 12, wherein the display medium layer comprises an electronic ink layer or an organic light emitting diode layer.

17. The inspection apparatus as recited in claim 12, wherein the pixel array substrate further comprises a common electrode terminal, the conductive structure of the photoelectric inspection device is extended outward from the base and electrically connected with the common electrode layer, and the conductive structure is configured to be in contact with the common electrode terminal of the pixel array substrate.

18. The inspection apparatus as recited in claim 17, wherein the electrical signals outputted by the signal source are configured to be inputted to the pixel units of the pixel array substrate and the common electrode terminal, and one of the electrical signals is transmitted to the common electrode layer of the photoelectric inspection device through the common electrode terminal.

19. The inspection apparatus as recited in claim 10, being configured to inspect the pixel array substrate comprising the pixel units, the pixel array substrate divided into a plurality of to-be inspected blocks respectively comprising the pixel units, wherein the photoelectric inspection device is divided into a plurality of inspection blocks, the inspection blocks are configured to respectively be in contact with the to-be inspected blocks, and the analysis unit is configured to compare differences between an optical property of the inspection blocks and an expected optical property of the inspection blocks of the photoelectric inspection device when the electrical signals inputted to the pixel units of the pixel array substrate and the photoelectric inspection device, if the optical property of one of the inspection blocks of the photoelectric inspection device is different from the expected optical property of one of the inspection blocks, then the pixel unit of to-be inspected block in contact with the one of the inspection blocks is determined to be abnormal.

* * * * *